US008951590B2

(12) United States Patent
Hätinger et al.

(10) Patent No.: US 8,951,590 B2
(45) Date of Patent: Feb. 10, 2015

(54) TUBULAR BAG PACKAGING AND METHOD FOR PRODUCING SUCH TUBULAR BAG PACKAGING

(75) Inventors: Klaus Dieter Hätinger, Pliezhausen (DE); Johannes Graf, Tübingen (DE)

(73) Assignee: Ritter Schönbuch Vermögensverwaltungs GmbH & Co. KG, Waldenbuch (DE)

( * ) Notice: Subject to any disclaimer, the term of this patent is extended or adjusted under 35 U.S.C. 154(b) by 559 days.

(21) Appl. No.: 13/224,359

(22) Filed: Sep. 2, 2011

(65) Prior Publication Data

US 2012/0058231 A1 Mar. 8, 2012

(30) Foreign Application Priority Data

Sep. 2, 2010 (EP) ..... 10009134

(51) Int. Cl.
*B65D 75/62* (2006.01)
*B65D 75/46* (2006.01)
*B65D 75/58* (2006.01)
(Continued)

(52) U.S. Cl.
CPC ..... *B65D 75/46* (2013.01); *B65D 75/5844* (2013.01); *B65B 9/06* (2013.01); *B65B 25/005* (2013.01); *B65B 51/16* (2013.01); *B65B 2220/08* (2013.01); *B65D 75/5827* (2013.01); *B65D 85/60* (2013.01)
USPC ..... 426/115; 426/122; 426/123; 426/394; 426/410; 53/133.8; 53/375.8

(58) Field of Classification Search
CPC ..... B65D 75/58–75/585
USPC ..... 426/115, 122–123, 394, 410; 53/476, 53/479, 480, 375.8, 133.5–133.8
See application file for complete search history.

(56) References Cited

U.S. PATENT DOCUMENTS 2,062,279 A * 11/1936 Vogt ..... 426/132
2,790,594 A * 4/1957 Hultkrans et al. ..... 229/87.05
(Continued)

FOREIGN PATENT DOCUMENTS

DE 33 27 566 A1 2/1985
DE 36 18 765 A1 12/1987
(Continued)

OTHER PUBLICATIONS

EP2426065 (EP 10 0009 134) ISR and search report (Feb. 15, 2011).*

*Primary Examiner* — Drew Becker
(74) *Attorney, Agent, or Firm* — Gudrun E. Huckett

(57) ABSTRACT

A tubular bag packaging for bar-shaped food products is made of a film with first and second longitudinal edges. The film has a first seal section at the first longitudinal edge. A flap section at the second longitudinal edge has a second seal section along the second longitudinal edge. The film is closed at the seal sections by forming a continuous back seam in longitudinal direction as a fold-over seam. The film is sealed at transverse edges by transverse seams. The back seam has end face edges adjoining the transverse seams. The flap section has a linear separation cut as a tearing aid disposed on at least one of the end face edges and extending away from the end face edge in longitudinal direction. The film in the area of the second seal section with linear separating cut has a pressure deformation line that extends in longitudinal direction.

17 Claims, 4 Drawing Sheets

(51) Int. Cl.

| | |
|---|---|
| ***B65B 9/06*** | (2012.01) |
| ***B65B 25/00*** | (2006.01) |
| ***B65B 51/16*** | (2006.01) |
| *B65D 85/60* | (2006.01) |

(56) References Cited

U.S. PATENT DOCUMENTS

| | | | | | |
|---|---|---|---|---|---|
| 2,791,324 | A | * | 5/1957 | Knoop et al. | 206/568 |
| 3,291,377 | A | * | 12/1966 | Eggen | 426/122 |
| 3,625,351 | A | * | 12/1971 | Eisenberg | 206/484 |
| 4,128,451 | A | * | 12/1978 | Sorce et al. | 156/555 |
| 4,139,643 | A | * | 2/1979 | Hix et al. | 426/122 |
| 4,598,826 | A | * | 7/1986 | Shinbach | 383/200 |
| 4,658,963 | A | * | 4/1987 | Jud | 229/87.05 |
| 4,826,011 | A | * | 5/1989 | Jud | 206/484 |
| 4,903,841 | A | * | 2/1990 | Ohsima et al. | 383/200 |
| 2013/0295242 | A1 | * | 11/2013 | Cheema | 426/123 |

FOREIGN PATENT DOCUMENTS

| | | | |
|---|---|---|---|
| DE | 89 04 192 | U1 | 7/1989 |
| EP | 0 968 931 | A1 | 1/2000 |
| WO | 2010/121731 | A1 | 10/2010 |

* cited by examiner

TUBULAR BAG PACKAGING AND METHOD FOR PRODUCING SUCH TUBULAR BAG PACKAGING

BACKGROUND OF THE INVENTION

The invention relates to a tubular bag packaging for bar-shaped food products, in particular for chocolate bars, wherein the tubular bag packaging extends in a longitudinal direction and in a transverse direction and comprises a film or foil with longitudinal edges extending in the longitudinal direction. The film or foil comprises a seal section extending along a first longitudinal edge and a flap section adjoining a second longitudinal edge and comprising a further seal section extending along the second longitudinal edge. The film or foil is closed to form a tubular bag at the seal sections with formation of a continuous back seam extending in the longitudinal direction and embodied as a fold-over seam. The tubular bag packaging is sealed at transverse edges positioned opposite each other in the longitudinal direction by means of transverse seams extending in the transverse direction.

The invention further concerns a food product comprising such a tubular bag packaging and a method for producing such a tubular bag packaging.

For packaging bar-shaped food products, in particular chocolate bars, so-called tubular bag packaging is used that is formed of a film or foil with longitudinal edges extending in the longitudinal direction. The film or foil has along its first longitudinal edge a sealing section and a flap section adjoining the second longitudinal edge with a further seal section extending along the second longitudinal edge. The film or foil is wrapped about the bar-shaped food product to a tubular shape and closed or sealed at the seal sections with formation of a continuous back seam that extends in longitudinal direction and is embodied as a fold-over seam. The fold-over seam including the flap section and the seal sections is folded over along a folding line and is placed flat onto the back of the packaging. Moreover, the tubular bag packaging at its transverse edges extending transversely to the longitudinal direction is sealed by means of transverse seams extending in the transverse direction.

The back seam that is embodied as a fold-over seam serves not only for producing the tubular shape but also for providing a configuration for a targeted opening of the packaging by the user. In particular, it is desired to open the tubular bag packaging at the back seam without tearing the film or foil material in an uncontrolled fashion. Remaining unconsumed quantities of the packaged contents can therefore remain in the already opened tubular bag packaging and can be stored therein.

Opening the packaging at the back seam is however difficult. A configuration of the tubular bag packaging as a so-called "pack with a snap" or "snap-open pack" is known in which the still packaged chocolate bar by snapping is broken apart and at the same time the back seam is pulled open. However, this requires that the chocolate bar is sufficiently hard for such a targeted breaking action. At higher temperatures, however, the chocolate becomes so soft that breaking of the back seam is not possible or possible only with difficulty. Moreover, this snap-open possibility is not always recognized by the consumer so that the consumer attempts to tear open the back seam of the packaging. However, such a tearing action has the result that the ripped-open film or foil will continue to tear in an uncontrolled fashion. Reuse of the open packaging for storing the unconsumed quantities of the package contents is therefore not possible or only possible to a limited extent.

SUMMARY OF THE INVENTION

It is therefore an object of the present invention to further develop a tubular bag packaging of the aforementioned kind such that a targeted opening is simplified.

In accordance with the present invention, this is achieved in that the back seam has an end face edge adjoining the transverse seam, in that the flap section in the area of the end face edge is provided with at least one linear separation cut as a tearing aid, wherein the separation cut begins at the end face edge and extends at least approximately parallel to the longitudinal direction, and in that the film or foil in the area of the seal section with the at least one linear separating cut comprises a pressure deformation line, wherein the pressure deformation line extends at least parallel to the longitudinal direction.

The invention has further the object to provide a packaged food product comprising a tubular bag packaging that can be handled by the consumer more easily for opening the packaging.

This object is solved by a packaged food product comprising a bar-shaped food product wherein the food product is packaged in a tubular bag packaging of the present invention.

The invention has further the object to provide a method for producing the aforementioned tubular bag packaging such that the produced tubular bag packaging can be easily torn open with a controlled advancing of the tear in the foil or film.

This object is solved for the method for producing a tubular bag packaging for bar-shaped food products such as chocolate bars in that the back seam has an end face edge adjoining the transverse seam, in that the flap section in the area of the end face edge is provided with at least one linear separating cut as a tearing aid, in that the separating cut begins at the end face edge and extends at least approximately parallel to the longitudinal direction, in that the sealed back seam is produced by means of two sealing rollers with interposition of the two seal sections and in that at least one of the sealing rollers has a profiling with which a pressure deformation line is generated.

According to the invention, it is provided that the back seam has an end face edge adjoining the transverse seam, wherein one of the flap sections in the area of the end face edge is provided with at least one linear separation cut as a tearing aid. The separation cut begins at the end face edge and extends at least approximately parallel to the longitudinal direction of the tubular bag packaging or the longitudinal direction of the film or foil provided for making the tubular bag packaging.

The at least one separating cut is located thus on only one of the two flap sections while the oppositely positioned flap section does not have such a separating cut. When the consumer of the tubular bag packaging desires to tear open the packaging at the back seam, the film or foil will only tear at the flap section that is provided with the separating cut while the oppositely positioned flap section does not tear. The produced initial tear will continue only within this particular flap section while the other flap section remains undamaged. Therefore, a controlled tear formation results where significant parts of the tubular bag packaging remain undamaged. The opened tubular bag packaging can be used further for storing of residual unconsumed quantities of the contents of the packaging.

In an advantageous further embodiment, on two oppositely positioned end face edges at least one separating cut is provided, respectively. In particular, on the end face edge several, and in particular five, separating cuts are provided. Preferably, the separating cuts, are arranged at a spacing of approximately 1.5 mm relative to each other. Advantageously, the separating cut, beginning at the end face edge, has a length of including 1.0 mm to including 3.0 mm.

By arranging the separating cuts at oppositely positioned end face edges, the tubular bag packaging can be torn open from both ends so that unsuccessful attempts are avoided. Moreover, opening of the tubular bag packaging is possible at the same time for right-handed people as well as for left-handed people with preferred movement directions. Because of the arrangement of several separating cuts, it is not important that the tearing force for opening the packaging be applied to a certain location. Instead, application of a pulling force in the area of the back seam or of the flap sections in almost any direction is sufficient causing the film or foil of the tubular bag packaging to tear at one of the several cuts. It has been found that with the aforementioned spacings and longitudinal dimensions an excellent compromise between mechanical integrity of the tubular bag packaging and easy tearing action for opening the packaging is provided.

In a preferred embodiment, the film or foil in the area of the seal section with the at least one linear separating cut has a pressure deformation line. The pressure deformation line extends preferably along the entire back seam. For producing the pressure deformation line, pressure is applied onto the film or foil such that a linear plastic cold deformation of the film or foil occurs. The film or foil is not completely separated or cut by the pressure deformation line but with respect to its cross-section only deformed to such an extent that for usual manipulation its structural integrity is maintained. As soon as the consumer however attempts to tear open the tubular bag packaging at the back seam, the material of one of the two flap sections will tear first at the separating cut. The resulting material stresses, beginning at the separating cut, extend into the pressure deformation line and cause the film or foil to continue to tear exactly at the pressure deformation line. Thus, a controlled tear formation is provided that leads to opening of the packaging in the area of the back seam. The opening location is however limited to the area of one flap section so that the remaining untorn packaging material including the oppositely positioned seal sections or flap sections can still be used for storing unconsumed quantities of the contents of the package.

In a preferred further embodiment of the invention, the tubular bag packaging has a back part that is adjoined by the flap section along a folding line. The pressure deformation line extends advantageously in the flap section between the seal section and the folding line, i.e., not within the sealed seal section. Tearing open the tubular bag packaging along the pressure deformation line is not hindered by the adhesion of the seal section. However, it may also be expedient that the pressure deformation line within the seal section extends on its side facing the folding line, i.e., near the edge of the sealed seal section where the effect of the adhesion of the seal section is minimal. This leads to the pressure deformation line of one seal section being supported by the adhering, oppositely positioned seal section so that it therefore cannot tear prematurely. Only upon targeted tearing action for opening the packaging, the tear formation along the line shape that is predetermined by the pressure deformation line will happen, wherein only the seal section with the pressure deformation line will tear. In this connection, a portion of the pressure-deformed seal section still adheres to the oppositely positioned seal section. This adhesion area is however so small that it can be removed or torn off by hand in a single movement without problems and in particular without damaging of the film or foil material.

Advantageously, several, in particular three, parallel extending pressure deformation lines are provided. The advantages of several pressure deformation lines are particularly noticeable in combination with several separating cuts. In this connection, it should be noted that the separating cuts and the pressure deformation lines in an advantageous embodiment of the invention are generated in separate working steps and therefore are not necessarily positioned directly on top of each other. When arranging several parallel extending pressure deformation lines, it is however ensured that at least one of the separating cuts is either immediately in overlap with one of the pressure deformation lines or has only a very small spacing relative thereto. As a result of this, it is ensured that the tear that begins at the separating cut will migrate into the closest pressure deformation line and will continue therein in a controlled fashion along the pressure deformation line.

According to the method according to the present invention for producing the aforementioned tubular bag packaging, it is provided that the sealed back seam according to a further embodiment is manufactured by means of two sealing rollers with interposition of the two seal sections, wherein at least one of the sealing rollers has a profiling with which the at least one pressure deformation line is generated.

Seal and pressure deformation line are produced in one cost-saving process step. It is ensured that the pressure deformation line within the flap section extends exactly at the predetermined location and therefore has its desired relative position relative to the sealed seam or the back seam. Since the pressure deformation line is generated during the sealing process, it is supported by the oppositely positioned seal section or flap section so that a premature tearing and thus damaging of the tubular bag packaging during the manufacturing process is reliably prevented.

In an advantageous further embodiment of the method, the profiling has an area with locally increased pressing force wherein the pressure deformation line is generated by the locally increased pressing force. In particular, it can be advantageous that the profiling of one sealing roller has at least one circumferential pointed edge and that the other sealing roller has a profiling with at least one concavely rounded circumferential groove, wherein the at least one circumferential pointed edge during the sealing process engages the at least one concavely rounded circumferential groove for producing the locally increased pressing force.

Because of the locally increased pressing force, it is ensured that in the neighboring areas with a lower pressing force relative to the locally increased pressing force, a reliable sealing action is produced while the locally increased pressing force also generates a one-sided pressure deformation line. By properly adjusting the locally increased pressing force, it is ensured that the corresponding seal section is provided under pressure, by plastic cold deformation, with a pressure deformation line but is not completely separated or cut though. In a preferred embodiment, comprising the at least one circumferentially extending pointed edge, the locally increased pressing force and thus the pressure deformation line are produced by means of this pointed edge only on one film or foil side while the oppositely positioned film side or the oppositely positioned flap section rests in the concavely rounded groove and is exposed therein to a comparatively minimal surface pressure.

In addition, it may be expedient that on at least one side, and in particular on both sides, of the circumferentially extending pointed edge a circumferential annular bead is formed that in cross-section is convexly rounded as part of the profiling of one of the sealing rollers wherein the radius of curvature of the annular bead is smaller than the radius of curvature of the concavely rounded circumferential groove of the other sealing roller and wherein the annular bead during the sealing process engages the concavely rounded circumferential groove of the other sealing roller for producing the locally increased pressing force. In this way, a supplemental plastic material deformation laterally to the pointed edge is produced that favors a clean tear extension along, but not necessarily exactly on, the pressure deformation line.

DESCRIPTION OF THE PREFERRED EMBODIMENTS

Figure 1:
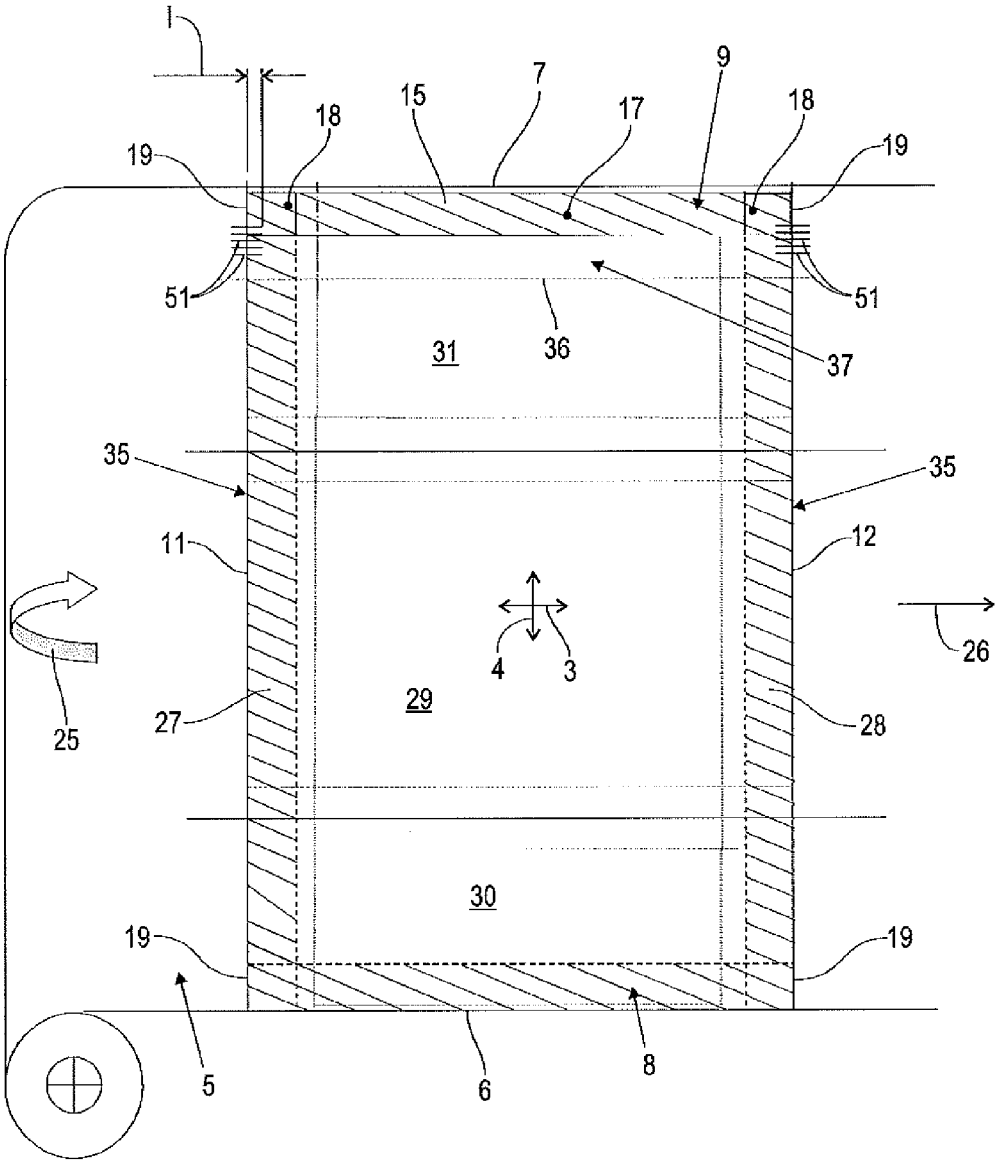
FIG. 1 is a schematic illustration of a film or foil removed from a roll with seal sections for forming the tubular bag packaging according to the invention.

FIG. 1 shows in a schematic view a film or foil 5 for producing a tubular bag packaging 1 illustrated in FIGS. 2 to 6. The film or foil 5 is comprised of a plastic material that is suitable for packaging food products. Preferably, OPP (oriented polypropylene) in particular in a multi-layer configuration with external acrylic coating is used. Preferably, the thickness of the film or foil 5 is in a range of including 35 μm up to including 45 μm (in the following only the term film will be used).

The film 5 is removed as endless or continuous material from a roll in accordance with arrows 25 and 26 and supplied to undergo further processing. The film or foil 5 has a longitudinal extension (length) in longitudinal direction 3, extending in the removal direction indicated by arrow 26, as well as transversely to the longitudinal direction 3, a transverse extension (width) in transverse direction 4. The film is laterally delimited by longitudinal edges 6, 7 extending in the longitudinal direction 3. The film 5 is divided into a central front part 29, a back part 30 that joins the longitudinal edge 6, a flap section 37 adjoining the oppositely positioned longitudinal edge 7, and a second back part 31 that is positioned between the front part 29 and the flap section 37. The flap section 37 adjoins along a folding line 36, disclosed in detail in the following, the second back part 31. Along both longitudinal edges 6, 7 the film 5 is provided with a seal section 8, 9, respectively, wherein the seal section 9 is positioned within the flap section 37, i.e., is a part of the flap section 37. Moreover, in transverse direction 4 seal sections 27, 28 are provided that relative to the longitudinal direction 3 are positioned at a spacing relative to each other and that, together with the seal sections 8, 9 extending along the longitudinal edges 6, 7, form a rectangular frame. The frame and a film portion defined thereby are delimited outside of the seal sections 8, 9 by the longitudinal edges 6, 7 and outside of the seal sections 27, 28 by the cutting lines 35. The film 5 that is initially continuous and contiguous is separated or cut at a later time in a way to be explained in the following along the cutting lines 35 (FIG. 4) in the transverse direction 4 so that along the cutting lines 35 transverse edges 11, 12 as well as end face edges 19 of a sealed back seam 10 (FIG. 5) are formed.

For simplifying the illustration, only a single film portion delimited by the longitudinal edges 6, 7 and the cutting lines 35 for forming an individual tubular bag packaging 1 (FIGS. 2 to 6) is illustrated. In reality, a plurality of such film portions that initially are formed as a one-piece endless film adjoin each other directly at the cutting lines 35.

The seal section 9 adjacent to the longitudinal edge 7 is divided into a center section 17, positioned between the seal sections 27, 28 extending in transverse direction 4, as well as end sections 18 positioned in the overlap area with the two seal sections 27, 28. The end sections 18 in longitudinal direction 3 are delimited by the cutting lines 35.

In the area of the cutting lines 35 and within the flap section 37 at least one linear separating cut 51 is provided. The at least one separating cut 51 begins at the cutting line 35 and extends within the flap section 37 at least approximately parallel to the longitudinal direction 3. In the illustrated embodiment, relative to the aforementioned individual film portions on both oppositely positioned cutting lines 35 there is a separating cut 51. Preferably, several, and shown here five, separating cuts 51 are provided, respectively, that extend parallel to each other and to the longitudinal direction 3. They extend, beginning at the cutting line 35 into the flap section 37 across a length of including 1.0 mm to including 3.0 mm, here approximately 2.0 mm, respectively. The length is selected such that the separating cuts 51 are completely located within the seal sections 9, 27, 28.

Some of the separating cuts 51, here more than half, namely three, separating cuts 51, extend in the flap section 37, viewed in the transverse direction 4, between the seal section 9 and the folding line 36 while the remaining separating cuts 51, here the smaller number of two separating cuts 51, extend in the flap section 37 within the seal section 9, viewed in the transverse direction 4, on the side of the seal section that is facing the folding line 36. However, another division may also be expedient in which the larger number of the separating cuts 51, or even all separating cuts 51, are positioned within the flap section 37 between the seal section 9 and the folding line 36. The separating cuts 51, relative to the transverse direction 4, are arranged at a spacing of approximately 1.5 mm relative to each other. The separating cuts 51 may already be existing in the delivery state of the film 5 wound onto the roll or can be produced subsequently after removal of the film from the roll and before the sealing process disclosed in the following is carried out. In the opposite seal section 8 such separating cuts 51 are not provided.

Figure 2:
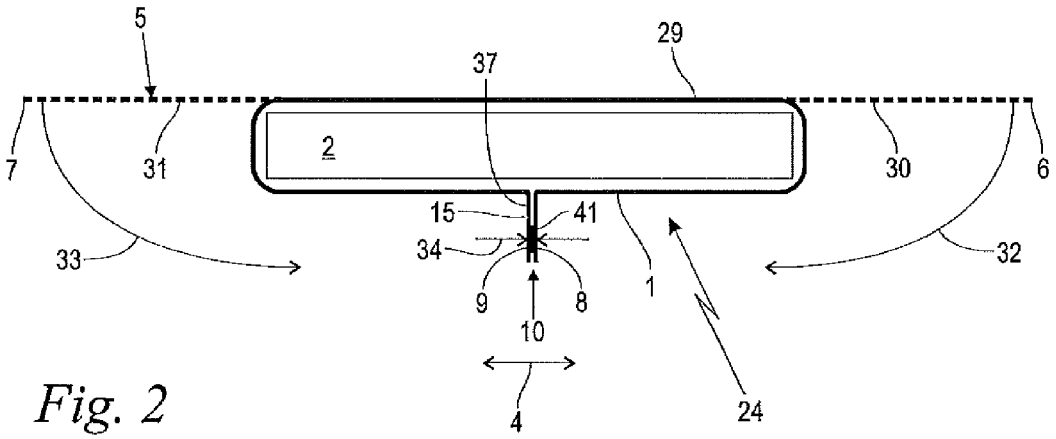
FIG. 2 is a schematic cross-sectional illustration of the film or foil according to FIG. 1 enclosing a bar-shaped food product with a tubular bag-type envelope.
Figure 4:
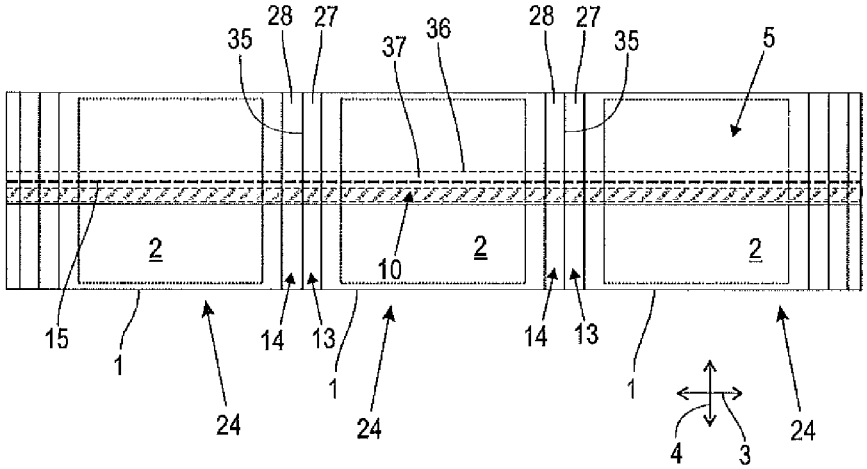
FIG. 4 is a plan view of the arrangement according to FIG. 3 with several bar-shaped food products arranged in a tubular film or foil with transverse seams arranged between the bar-shaped food products.

FIG. 2 shows in a schematic transverse illustration a bar-shaped hard food product in the form of a chocolate bar 2 (as an example) during the packaging process with the film 5 according to FIG. 1. However, another bar-shaped food product can be packaged also. In the packaging process the chocolate bar 2 is covered by the front part 29 of the film 5 so that the two back parts 30, 31 project laterally past the chocolate bar 2 in the transverse direction 4. The back parts 30, 31, in accordance with arrows 32, 33, are folded downwardly about the chocolate bar 2 for forming a tubular bag packaging 1. When doing so, the seal sections 8, 9 extending in the longitudinal direction 3 (FIG. 1) abut each other in flat contact such that they project away from the tubular bag packaging 1 and rest against each other with their inner side that is otherwise facing the chocolate bar 2. At least at one of the two seal sections 8, 9 a schematically indicated cold seal glue 41 is applied by means of which the two seal sections 8, 9 with pressure application in the direction of arrows 34 are sealed to each other for formation of back seam 10 extending in the longitudinal direction 3 (FIG. 4). Instead of the cold seal glue 41 also a hot seal glue or any other form of seal can be expedient.

Figure 7:
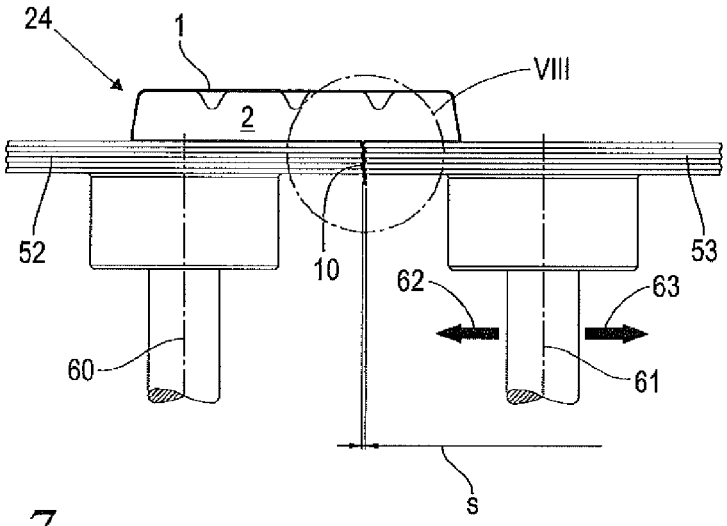
FIG. 7 is a plan view of a pair of sealing rollers for producing the sealed back seam according to FIGS. 2 through 6.
Figure 8:
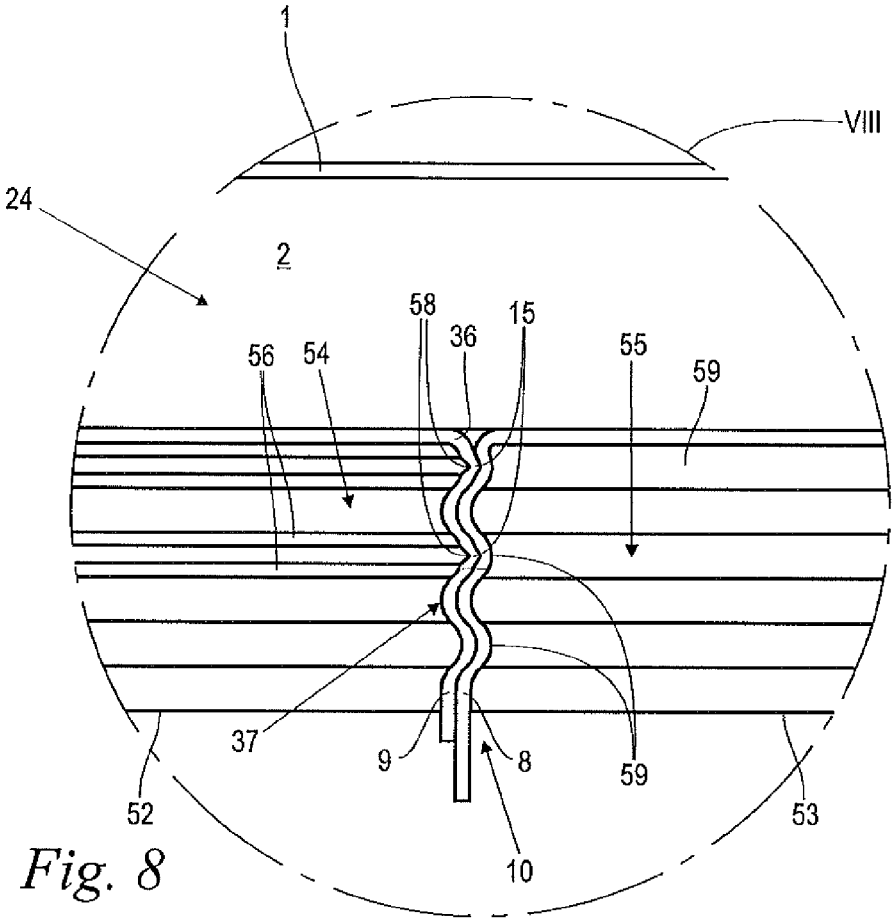
FIG. 8 is a detail view VIII according to FIG. 7 with details of the sealing roller profiling for producing a locally increased pressing force and thus the pressure deformation line.

The sealing action of the back seam 10 is realized between two sealing rollers 52, 53, and this will be disclosed in connection with FIGS. 7 and 8. Upon sealing, at the same time also at least one pressure deformation line 15 is generated in the flap section 37 that is also provided with the at least one separating cut 51 (FIG. 1). In the area of the additional seal section 8 or a correlated flap section, not identified here, the film 5 has neither a separating cut 51 nor a pressure deformation line 15. In FIG. 2, it can be seen that the indicated pressure deformation line 15 is positioned within the flap section 37 but not within the seal section 9 that is sealed by the cold seam glue 41 to the seal section 8.

Figure 3:
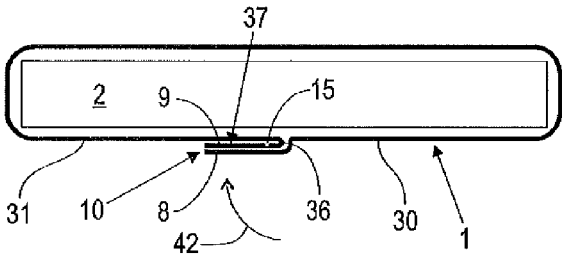
FIG. 3 shows the arrangement according to FIG. 2 with sealed and folded-over back seam having a linear cross-sectional weakened portion.

After completion of the sealing action of the back seam 10, the back seam 10 is folded, in accordance with arrow 42, flat onto the tubular bag packaging 1 as is illustrated in schematic cross-section illustration of FIG. 3. The back seam 10 is in this way embodied as a folded over seam which rests with flap section 37 and its two seal sections 8, 9 flat on the second back part 31. The folding direction in accordance with arrow 42 is selected such that the flap section 37 with the at least one pressure deformation line 15 and the at least one separating cut 51 (FIG. 1) is folded over along the folding line 36 by 180 degrees relative to the second back part 31 is resting directly flat on the second back part 31 and therefore is covered outwardly, i.e., facing away from the chocolate bar 2, by the additional seal section 8.

FIG. 4 shows a plan view of the arrangement according to FIG. 3, according to which the film 5 as a whole is closed first to an endless tube along the back seam 10 that is configured as a fold-over seam. In this way, a row of chocolate bars 2 are enclosed or enveloped by the tubular shape of the film. It can be seen that the back seam 10 and also the at least one pressure deformation line 15 extend continuously in longitudinal direction 3. The pressure deformation line 15 extends within the flap section 37 and is positioned, relative to the transverse direction 4, between the seal sections 8, 9 that are sealed to each other and the folding line 36. Between the individual chocolate bars 2 the seal sections 27, 28 extending in the transverse direction 4 in accordance with FIG. 1 are located and, in this state, are sealed with formation of transverse seams 13, 14. Between the immediately adjoining transverse seams 13, 14, a cutting line 35 extends (mentioned in connection with FIG. 1); along this cutting line 35, the film tube is then cut in transverse direction 4. In this way, individualized packaged food products 24 are produced wherein the chocolate bar 2 is hermetically and seal-tightly packaged in an individual tubular bag packaging 1.

Figure 5:
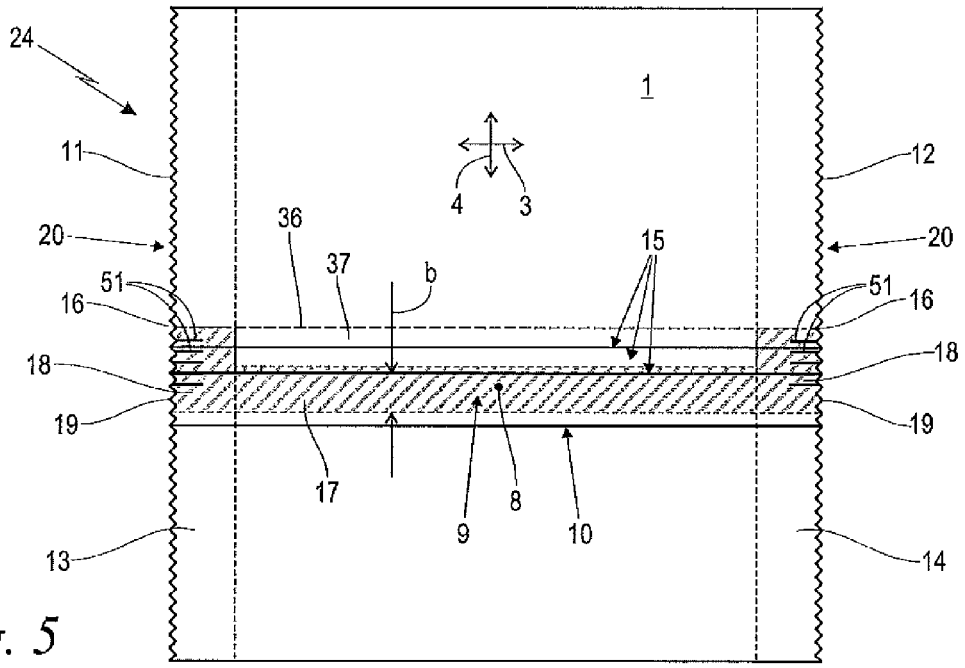
FIG. 5 is a plan view of an individual food product separated from the arrangement according to FIG. 4 with details of the configuration of the back seam and the linear cross-sectional weakened portion extending thereat.

FIG. 5 shows in a schematic plan view such an individualized afore described packaged food product 24 with the tubular bag packaging 1, that is closed or sealed along the back seam 10 and along the transverse seams 13, 14. In the illustrated folded-over state of the back seam 10, in accordance with the above description, the seal section 8 without pressure deformation line 15 is positioned above or on the exterior side of the flap section 37 provided with the pressure deformation line 15. For simplifying the illustration, the at least one pressure deformation line 15 is however illustrated as a solid line. Moreover, an embodiment may be expedient also in which indeed the pressure deformation line 15 is not in the lower covered flap section 37 but in the upper exposed flap section provided with the seal section 8. In supplementing the schematic illustration according to FIGS. 2 to 4, not just one pressure deformation line 15 is illustrated. Instead, optionally several, as illustrated here preferably three, linear pressure deformation lines 15 can be provided and can extend parallel to each other.

The seal sections 8, 9 extending in the longitudinal direction 3 have a width b that is determined by the width of the cold seal glue 41 (FIG. 2) or another sealing agent. It can be seen that the pressure deformation lines 15 extend along the entire back seam 10 and mostly outside of the width b relative to the transverse direction 4. Also, the pressure deformation lines 15 extend straight and parallel to the longitudinal direction 3 across the entire length of the back seam 10. Two of the pressure deformation lines 15 extend in the flap section 37 relative to the transverse direction 4 between the seal section 9 and the folding line 36. Optionally, one pressure deformation line 15, here the third pressure deformation line 15, extends within the seal section 9 near the boundary of the seal section 9 on its side or half that is facing the folding line 36.

The tubular bag packaging 1 has in transverse direction 4 transverse edges 11, 12 where it is sealed by means of transverse seams 13, 14. Moreover, the back seam 10, adjoining the two transverse seams 13, 14, has an end face edge 19, respectively, having a width corresponding to that of the flap section 37; the edges 19 in folded-over state of the back seam 10 rest flat on and parallel to the transverse edges 11, 12. The end face edges 19 of the back seam 10 form together with the transverse edges 11, 12 a crossing point 16 that is clearly shown in FIG. 6.

The end face edges 19 together with the transverse edges 11, 12 are formed by the afore described cut along the cutting lines 35 (FIG. 4) and are embodied here as a serrated cut 20. Instead of this serrated cut 20 also straight cuts can be provided. The end face edges 19 and transverse edges 11, 12 are positioned at the location where prior to this the cutting lines 35 (FIG. 1) were located. Accordingly, the separating cuts 51, beginning at end face edges 19, extend parallel to the longitudinal direction 3 with the dimensions and other features as indicated in connection with FIG. 1. The separating cuts 51 are positioned either immediately adjacent to at least one pressure deformation line 15 or even in overlap therewith and form a tearing aid for tearing open the tubular bag packaging 1. By manually pulling on the end section 18, tearing of the seal section 9 at one of the separating cuts 51 is initiated. The resulting tear migrates into the pressure deformation line 15 that is closest and continues along this pressure deformation line across the entire length of the back seam 10.

Figure 6:
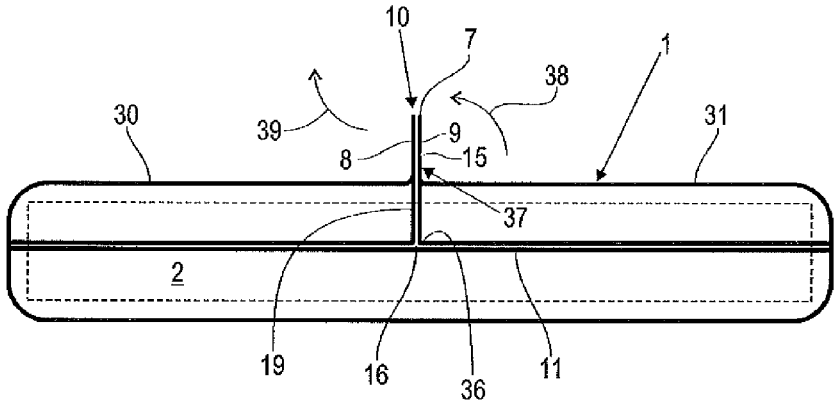
FIG. 6 is a cross-sectional illustration of the arrangement according to FIG. 5 during the process of tearing open the packaging.

FIG. 6 shows a schematic front view of the packaged food product 24 according to FIG. 5 during the opening process of the tubular bag packaging 1. Beginning at the flat folded-over position of the back seam 10 according to FIGS. 3 to 5, the back seam 10 is manually pulled upwardly as indicated by arrow 38 into an upright position wherein the crossing point 16 between the end face edge 19 and the adjoining transverse edge 11, 12 (FIG. 5) becomes clearly visible. For opening the tubular bag packaging 1 the consumer will grip the sealed back seam 10 preferably at one of the end sections 18 (FIG. 5) and applies laterally and upwardly a pulling action in accordance with arrow 39. For simplifying the illustration only one of several pressure deformation lines 15 is illustrated. When looking at FIG. 5 and FIG. 6, it is apparent that the tear that is initiated at one of the separating cuts 51 upon further pulling action will continue along the entire pressure deformation line 15 wherein however only the flap section 37 is separated.

Because there are no separating cuts 51 at the oppositely positioned flap section with the seal section 8, the latter will not tear. The seal section 8 is removed in accordance with arrow 39 together with the adjoining first back part 30 wherein the two transverse seems 13, 14 without further uncontrolled tearing of the film 5 are pulled open. Inasmuch as the tubular bag packaging 1 is torn open along such a pressure deformation line 15 that is positioned between the seal section 9 and the folding line 36, the back seam 10 must not be pulled open at the seal sections 8, 9 that are sealed with each other so that the force to be applied manually is minimal. Inasmuch as the tubular bag packaging 1 is torn open along the pressure deformation line 15 that is positioned within the seal section 9, only a portion of the back seam 10 must be pulled open at the seal sections 8, 9 that are sealed with each other. The outer greater portion of the seal section 9 that remains between the longitudinal edge 7 and the pressure deformation line 15 remains adhered to the seal section 8 so that pulling off the inner smaller portion of the seal section 9 connected to the second back part 31 requires no significant increase of the needed manual force application. The remaining portion of the flap section 37, optionally also of the seal section 9, remains undamaged and connected with the second back part 31. The film 5 is torn open only along the pressure deformation line 15 and has otherwise no further tears or damages. Unconsumed quantities of the opened chocolate bar 2 or another bar-shaped food product can therefore be further stored without problems in the opened tubular bag packaging 1.

Moreover, the tubular bag packaging 1 with its back seam 10 is embodied by its geometric configuration and type of sealing action in the way known as so-called "pack with a snap" or "snap-open pack". By snapping or breaking the chocolate bar 2 at the same time the back seam 10 can be pulled open wherein this packaging then does not open along one of the pressure deformation lines 15. Therefore, the consumer has two alternatives of opening mechanisms at his disposal. The additional configuration as a so-called "snap-open pack" however is not required in the context of the present invention.

FIG. 7 shows in a plan view a pair of sealing rollers for producing the sealed back seam 10 according to FIGS. 2 to 6 in an inventive configuration of the process of manufacture according to the present invention. Both sealing rollers 52, 53 are supported to be rotatable in opposite directions about axis-parallel axes of rotation 60, 61 and can be driven in rotation. One sealing roller 53 is adjustable relative to the other sealing roller 52 in accordance with arrows 62, 63 with regard to radial spacing in such a way that a gap or nip s between the circumferential surfaces of the sealing rollers 52, 53 can be adjusted.

The two sealing rollers 52, 53 are shown during the sealing action of the back seam 10. In this connection, the tubular bag packaging 1 with chocolate bar 2 contained therein for producing the packaged food product 24 in accordance with the illustration of FIG. 2 is supplied such to the pair of sealing rollers 52, 53 that the still upright, not yet folded-over, back seam 10 projects into the gap between the circumferential surfaces of the sealing rollers 52, 53. The nip s is adjusted such that the back seam 10 is subjected to a sufficient surface pressure for sealing by means of the cold sealing glue 41 (FIG. 2). Inasmuch as instead of the cold sealing glue 41 (FIG. 2) a hot sealing glue or the like is provided, the circumferential surfaces of the sealing rollers 52, 53 may also be heated wherein the heated area is however limited to the area of the seal sections 8, 9 (FIG. 5) and does not affect the area that is outside thereof and provided with the pressure deformation lines 15 (FIG. 5). In any case, by the applied pressure between the circumferential surfaces of the sealing rollers 52, 53 a sealing action of the back seam 10 at the seal sections 8, 9 (FIG. 5) occurs. By oppositely oriented rotation of the sealing rollers 52, 53, the back seam 10 is produced relative to the longitudinal direction 3 in an endless process with any length in accordance with the illustration of FIG. 4.

FIG. 8 shows the detail VIII of FIG. 7 in the area of the contacting circumferential surfaces of the two sealing rollers 52, 53. Both sealing rollers 52, 53 have at their circumferential surfaces a circumferentially extending profiling 54 or a circumferentially extending profiling 55 that in cross-section have a wavy shape. One of the peaks of a sealing roller 52, 53 engages a valley of the oppositely positioned sealing roller 53, 52, respectively. Between the profilings, the two seal sections 8, 9 are positioned and are therefore sealed with each other in accordance with the aforementioned wavy shape.

Moreover, the illustration according to FIG. 8 also shows that the profiling 54 of the sealing roller 52 as a result of its geometric configuration is designed to generate a locally increased pressing force and thereby cause the pressure deformation lines 15. In the embodiment according to FIG. 8, the profiling 54 of the sealing roller 52 has for this purpose at least one circumferentially extending pointed edge 58; in the shown embodiment, there are two circumferentially extending pointed edges 58 and a rounded bulge. The profiling 55 of the other sealing roller 53 has at least one (shown here are three) concavely rounded circumferential grooves 59 in cross-section wherein the circumferential pointed edges 58 of the sealing roller 52 during the sealing process engage the correlated concavely rounded grooves 59 of the other sealing roller 53 for producing the locally increased pressing force. Moreover, optionally, relative to the axial direction on at least one side, here on both sides, of the circumferentially extending pointed edge 58 a convexly rounded circumferential annular bead 56 as a part of the profiling 54 of the sealing roller 52 is provided. The radius of curvature of the annular bead 56 is smaller than the radius of curvature of the concavely rounded circumferential grooves 59 of the other sealing roller 53. The annular beads 56 also engage during the sealing process the correlated concavely rounded grooves 59 of the other sealing roller 53 for producing the locally increased pressing force.

Outside of the circumferential pointed edges 58 and the circumferential annular beads 56, the profiling 54 of the sealing roller 52 corresponds to the profiling 55 of the other sealing roller 53. In this way, it is achieved that the otherwise constant nip s (FIG. 7) locally in the area of the pointed edges 58 and the annular beads 56 is smaller than in the other sections of the profilings 54, 55. In addition to the sealing action of the seal sections 8, 9 relative to each other between the sealing rollers 52, 53, the flap section 37 at the aforementioned locations is provided as a result of the locally increased surface pressure with the pressure deformation lines 15 without completely separating, or cutting apart, the flap section 37. The flap section 37 is subjected at the circumferential pointed edges 59 and also at the annular beads 56 to a locally increased pressing force so that the pressure deformation lines 15 (FIG. 5) are generated by plastic cold deformation of the film material. The oppositely positioned seal section 8 is positioned in the rounded grooves 59 so that here the local pressing force is smaller and such plastic pressure deformation line is not formed. The pressure deformation line of the film material is realized primarily at the pointed edges 58 but to a minimal degree also at the annular beads 56. Also, it is shown that the outer edge of the sealing roller 52 in the area of the folding line 36 is rounded. In this way it is ensured that at the folding line 36 no pressure deformation of the film material occurs so that the film material at this location cannot tear in an uncontrolled fashion.

The specification incorporates by reference the entire disclosure of European priority document 10 009 134.7 having a filing date of Sep. 2, 2010.

While specific embodiments of the invention have been shown and described in detail to illustrate the inventive principles, it will be understood that the invention may be embodied otherwise without departing from such principles.

What is claimed is:

1. A tubular bag packaging for bar-shaped food products, wherein the tubular bag packaging has a longitudinal extension in a longitudinal direction and a transverse extension in a transverse direction perpendicular to said longitudinal direction; the tubular bag packaging comprising:

a film with first and second longitudinal edges extending in said longitudinal direction;

said film comprising a first seal section extending along said first longitudinal edge and a flap section adjoining said second longitudinal edge, wherein said flap section has a second seal section extending along said second longitudinal edge;

said film sealed at said first and second seal sections to form a continuous back seam extending in said longitudinal direction, wherein said back seam is embodied as a fold-over seam;

said film sealed at transverse edges by a transverse seam, respectively, said transverse seams extending in said transverse direction;

said back seam having an end face edge adjoining said transverse seams, respectively;

wherein said flap section has a linear separation cut as a tearing aid for producing a tear in said film, wherein said linear separation cut is disposed on at least one of said end face edges and extends away from said end face edge at least approximately parallel to said longitudinal direction;

wherein said film in the area of said second seal section of said flap section provided with said linear separating cut comprises a pressure deformation line that is generated by a linear plastic cold deformation of said film, wherein said film has a deformed weakened cross-section along said pressure deformation line but said film is not completely separated along said pressure deformation line, and wherein said pressure deformation line extends at least approximately parallel to said longitudinal direction.

2. The tubular bag packaging according to claim 1, wherein each one of said end face edges has at least one of said linear separating cut.

3. The tubular bag packaging according to claim 1, wherein said at least one end face edge has several of said linear separating cut.

4. The tubular bag packaging according to claim 3, wherein said at least one end face edge has five of said linear separating cut.

5. The tubular bag packaging according to claim 3, wherein said linear separating cuts are positioned at a spacing of approximately 1.5 mm relative to each other.

6. The tubular bag packaging according to claim 1, wherein said linear separating cut begins at said end face edge and has a length of including 1.0 mm to including 3.0 mm.

7. The tubular bag packaging according to claim 1, wherein said pressure deformation line extends across an entire length of said back seam.

8. The tubular bag packaging according to claim 1, wherein said film has a back part that adjoins said flap section along a folding line and wherein said pressure deformation line is positioned in said flap section between said second seal section and said folding line or within said second seal section at a side that is facing said folding line.

9. The tubular bag packaging according to claim 1, wherein several of said pressure deformation line are provided that extend parallel to each other.

10. The tubular bag packaging according to claim 1, wherein two of said pressure deformation line are provided that extend parallel to each other.

11. A packaged food product comprising a bar-shaped food product and a tubular bag packaging according to claim 1 in which said bar-shaped food product is packaged.

12. The packaged food product according to claim 11, wherein the bar-shaped food product is a chocolate bar.

13. A method for producing a tubular bag packaging for a bar-shaped food product, wherein the tubular bag packaging has a longitudinal extension in a longitudinal direction and a transverse extension in a transverse direction perpendicular to said longitudinal direction; wherein the tubular bag packaging comprises a film with first and second longitudinal edges extending in said longitudinal direction; said film comprising a first seal section extending along said first longitudinal edge and a flap section adjoining said second longitudinal edge, wherein said flap section has a second seal section extending along said second longitudinal edge; said method comprising the steps of:

sealing said first and second seal sections by producing a continuous back seam, extending in said longitudinal direction, by interposing said first and second seal sections between sealing rollers and closing said film at said first and second seal sections with said sealing rollers, wherein said back seam is embodied as a fold-over seam;

sealing said film at transverse edges by a transverse seam, respectively, said transverse seams extending in said transverse direction, wherein said back seam has an end face edge adjoining said transverse seams, respectively;

providing said flap section with a linear separation cut, as a tearing aid for producing a tear in said film, on at least one of said end face edges so as to extend away from said end face edge at least approximately parallel to said longitudinal direction;

generating a pressure deformation line that extends at least approximately parallel to said longitudinal direction by applying, with a first profiling that is provided on a first one of said sealing rollers, pressure onto said film such that a cross-section of said film undergoes a linear plastic cold deformation to a deformed weakened cross-section without said film being separated completely.

14. The method according to claim 13, wherein said first profiling has an area with a locally increased pressing force, wherein said pressure deformation line is generated by said locally increased pressing force.

15. The method according to claim 14, wherein said first profiling of said first sealing roller comprises at least one circumferentially extending pointed edge and wherein a second one of said sealing rollers has a second profiling with at least one concavely rounded circumferential groove, wherein, during the step of sealing said first and second seal sections, said at least one circumferential pointed edge engages said at least one concavely rounded circumferential groove for producing said locally increased pressing force.

16. The method according to claim 15, wherein on one side of said circumferential pointed edge an annular circumferential bead that in cross-section is convexly rounded is provided as a part of said first profiling, wherein a radius of curvature of said annular bead is smaller than a radius of curvature of said concavely rounded circumferential groove, and wherein said annular bead during the step of sealing said first and second seal sections engages said concavely rounded circumferential groove for producing said locally increased pressing force.

17. The method according to claim 15, wherein on both sides of said circumferential pointed edge an annular circumferential bead that in cross-section is convexly rounded is provided as a part of said first profiling, wherein a radius of curvature of said annular beads is smaller than a radius of curvature of said concavely rounded circumferential groove, and wherein said annular beads during the step of sealing said first and second seal sections engage said concavely rounded circumferential groove for producing said locally increased pressing force.

* * * * *